US005725426A

United States Patent [19]

Alvarez

[11] Patent Number: 5,725,426

[45] Date of Patent: Mar. 10, 1998

[54] PORTABLE AND DISPOSABLE STERILIZED OPERATING ENVIRONMENT

[76] Inventor: Henry Alvarez, 3218 Ponce De Leon Blvd., Coral Gables, Fla. 33134

[21] Appl. No.: 578,282

[22] Filed: Dec. 26, 1995

[51] Int. Cl.[6] ..... F24F 3/16

[52] U.S. Cl. ..... 454/187; 55/385.2; 135/90; 135/93; 454/251

[58] Field of Search ..... 454/187, 251, 454/338; 135/90, 93; 55/385.2

[56] References Cited

U.S. PATENT DOCUMENTS

| | | | |
|---|---|---|---|
| 1,376,218 | 4/1921 | Morant | 135/90 |
| 2,463,090 | 3/1949 | Dixon et al. | 135/90 X |
| 2,694,403 | 11/1954 | Hudson | 135/90 |
| 2,702,546 | 2/1955 | Gilroy et al. | 135/90 X |
| 3,265,059 | 8/1966 | Matthews | 135/90 X |
| 3,505,989 | 4/1970 | Truhan . | |
| 3,709,210 | 1/1973 | Matthews . | |
| 3,878,570 | 4/1975 | Donnelly | 55/385.2 X |
| 4,129,122 | 12/1978 | Dout et al. . | |
| 4,267,769 | 5/1981 | Davis et al. . | |
| 4,549,472 | 10/1985 | Endo et al. . | |
| 4,581,986 | 4/1986 | Conklin et al. | 454/187 |
| 4,608,066 | 8/1986 | Cadwell, Jr. | 454/187 X |
| 4,667,579 | 5/1987 | Daw . | |
| 4,676,144 | 6/1987 | Smith . | |
| 4,769,958 | 9/1988 | Limp . | |
| 4,804,392 | 2/1989 | Spengler | 454/187 X |
| 5,256,105 | 10/1993 | Austin . | |
| 5,279,632 | 1/1994 | Decker et al. . | |
| 5,314,377 | 5/1994 | Pelosi, III | 135/93 X |
| 5,331,785 | 7/1994 | Brak . | |
| 5,377,461 | 1/1995 | DeGrada et al. . | |
| 5,430,980 | 7/1995 | Ferrier | 135/90 X |

FOREIGN PATENT DOCUMENTS

| | | | |
|---|---|---|---|
| 964953 | 3/1975 | Canada | 135/90 |

*Primary Examiner*—Harold Joyce

*Attorney, Agent, or Firm*—Fay, Sharpe, Beall, Fagan, Minnich & McKee

[57] ABSTRACT

A portable and disposable operating environment including at least one substantially flexible material panel which is removably secured to a rigid support so as to define and drape over an operating area. The portable and disposable operating environment also includes at least one flow through passage which is structured to receive a supply of purified air therein and direct it into the operating area defined by the flexible material panel. The purified air is structured to continuously flow into at least one flow through passage defined in the flexible material panel so that there is continuous sterile air circulation within the operating area defined thereby.

15 Claims, 4 Drawing Sheets

PORTABLE AND DISPOSABLE STERILIZED OPERATING ENVIRONMENT

BACKGROUND OF THE INVENTION

1. Field of the Invention

The present invention relates to a portable and disposable sterilized operating environment which provides a substantially sterile and sanitary enclosed operating area fort he performance of various clinical procedures, and which is portable, easily assembled, inexpensive, and can conveniently be disassembled and disposed of.

2. Description of the Related Art

Whenever any major, or even minor surgical procedure must be performed on a patient, ideal circumstances require that those procedures be performed within a sterilized operating room. In particular, it is generally desirable to ensure that external contaminants are not permitted to affect the patient, and possibly lead to infection thereof.

Typically, most hospitals and clinics, wherein surgical procedures are performed on a frequent basis, include dedicated sterilized operating rooms within which all procedures are to be performed. These sterile operating rooms are built with great care, and at generally great expense in order to ensure that maximum sterile integrity is maintained and that the various procedures to be performed are performed in the safest environment possible. Of course, as can be appreciated, only a limited number of specifically dedicated and configured operating rooms are generally available for the performance of necessary procedures. As such, scheduling and the lack of an emergency situation are important considerations regarding the availability of an operating room for performing a specific procedure. Naturally, the more minor the procedure, the more difficult it may be to get operating room scheduling when desired.

Frequently, doctors in smaller clinics and personal offices are called upon to perform minor surgical procedures. These procedures, which are generally performed on an "out-patient" type basis, although ideally performed in a sterilized operating room, are, however, often performed right in the doctor's office or an examination room which is available to the doctor. In particular, the scheduling difficulties associated with getting an operating room at a nearby hospital, and the substantial additional cost associated with utilizing an operating room, make it substantially impractical to perform the minor procedure outside of the office or clinic. Furthermore, because of the generally specialized nature of conventional operating room construction, and the expense of dedicating valuable space in the office or clinic for an occasionally used purpose, it is usually not feasible for doctors to include specific, dedicated operating rooms within their offices or clinics. Accordingly, doctors under these circumstances attempt to maintain the most sterile conditions possible and merely perform those minor procedures in the office when necessary.

In addition to minor surgical procedures performed in a doctor's office or a clinic, it is often the case that emergency surgical procedures must be performed at a remote site. Such circumstances can vary from a military setting, to a wilderness setting wherein an immediate procedure must be performed to save a patient's life. Similarly, emergency medical technicians arriving in an ambulance or rescue vehicle must also frequently perform immediate, emergency procedures in order to stabilize a patient for transport to a hospital. Due, however, to the severe emergencies often involved in such circumstances, the requirement of a sterile work area must be foregone in favor of immediate emergency action.

Accordingly, there is a substantial need in the art for a disposable and portable sterilized operating area which identifies, addresses, and utilizes the previously unrecognized minimal requirements of a sterile operating area, in order to combine maximum functionality and convenience with safety. Furthermore, there is need for such a portable and disposable sterile operating environment which can be quickly and conveniently erected and taken down in any location, thereby making it a convenience for use by a doctor in an office or clinic which will promote the use of a sterile environment for even the most minor procedures, and ensuring that a used or potentially contaminated operating environment may be disposed of and quickly and easily replaced with a new sterile operating environment instead of requiring cleaning between each procedure. Additionally, there is a need for a portable and disposable operating environment which can be quickly, safely and effectively erected and implemented in a remote emergency situation, thereby providing for substantially increased patient safety without compromising time considerations by requiring extensive delays prior to action.

In the past, others have attempted to provide sterile confinement/isolation assemblies which are temporary and can be brought to the patient. Such assemblies, however, are primarily directed towards providing a specialized isolation chambers wherein a sick and/or contagious patient can be maintained in a completely controlled, completely sterile and completely isolated environment. Because such assemblies are intended for extended use, they generally include a rigid framework which must be precisely erected prior to effectively sealing off the interior enclosed area. Moreover, such assemblies are designed to provide for complete enclosure, and as such necessitate that a dedicated, isolated area be provided for the erection of the structure, and that every item to remain within the isolation structure be completely sterilized in order to maintain the integrity of the isolation chamber. Also, after the isolation chamber becomes contaminated by a patient it must remain in place to avoid having to move the patient to a new isolation chamber, a necessity which may prolong recovery time.

Accordingly, it is evident that such isolation assemblies, while designed to provide portability, still require time consuming and often complex erection and sterilization procedures prior to their implementation. Because such isolation chambers are meant to serve the more long term purpose, the additional time necessary to properly erect and maintain can be taken; however, it is seen that such devices would be completely ineffective and impractical in an emergency situation, when performing a minor, "out-patient" procedure, or when having to perform multiple procedures on different patients. Specifically, it would be unfeasible for a doctor in an office or clinic to completely dedicate an area in that office for an isolation chamber such as those of the unrelated art relating to isolation chambers. More importantly, however, such devices could not be properly erected in a remote, emergency type situation due to the severe time constraints associated with on-site emergency procedures.

SUMMARY OF THE INVENTION

The present invention is directed towards a portable and disposable operating environment designed to provide a substantially sterile and sanitized area which is also portable and can be easily erected for use or disassembled for disposal and quickly replaced with a sterile, conveniently storable assembly.

The portable and disposable operating environment includes at least one large, substantially flexible material panel. Further, the operating environment includes a generally rigid support to which the flexible material panel is removably secured. In particular, fastening means are included and removeably secure the flexible material panel to the rigid support so that the flexible material panel at least partially defines and drapes over an operating area within which a procedure is to be performed.

Additionally, the portable and disposable operating environment includes at least one flow through passage. The flow through passage is specifically structured and disposed to direct air flow into the operating area defined by the flexible material panel. Further, connected with the flow through passage are purified air supply means. The purified air supply means are structured to sterilize air flow therethrough, and subsequently direct the sterilized air into the flow through passage, so that there is continuous sterile air circulation within the operating area.

It is an object of the present invention to provide a portable and disposable operating environment which provides a substantially sanitary and sterile operating area.

Another object of the present invention is to provide a portable and disposable operating environment which can be easily and conveniently erected for temporary and effective use.

It is a further object of the present invention to provide a portable and disposable operating environment which can be erected in a furnished office or room without requiring removal of existing furniture or fixtures in the room.

It is also an object of the present invention to provide a portable and disposable operating environment which can be easily dismantled and disposed of in case of contamination and/or after a single use.

An additional object of the present invention is to provide a portable and disposable operating environment which is sufficiently convenient to erect and disassemble so that a user may alternate between utilizing a room as a sterilized operating environment, and using the same room for other purposes several times during the same day.

Another object of the present invention is to provide a portable and disposable operating environment which can be erected within a room or office without requiring any permanent alterations to be made to the room.

Still another object of the present invention is to provide a portable and disposable operating environment which is relatively inexpensive so that it allows physicians, dentists, oral surgeons, eye surgeons, and other health care professionals to perform minor surgical procedures in their offices in a cost effective manner.

An additional object of the present invention is to provide a portable and disposable operating environment which will easily and conveniently increase the safety of various procedures already performed by a practitioner outside of a specifically dedicated operating room, without requiring significant adaptation or modification of their usual work area.

Yet another object of the present invention is to provide a portable and disposable operating environment which can be easily transported to and erected in any remote emergency environment, such as in a military or remote wilderness location, in order to provide a safe operating area within which to perform an emergency procedure.

Also an object of the present invention is to provide a portable and disposable operating environment which allows an emergency practitioner to safely and quickly perform an emergency procedure without having to decide between a possibly dangerous and timely transport of an emergency patient, and the risk of serious infection if the necessary emergency procedure is immediately performed at the remote emergency location.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
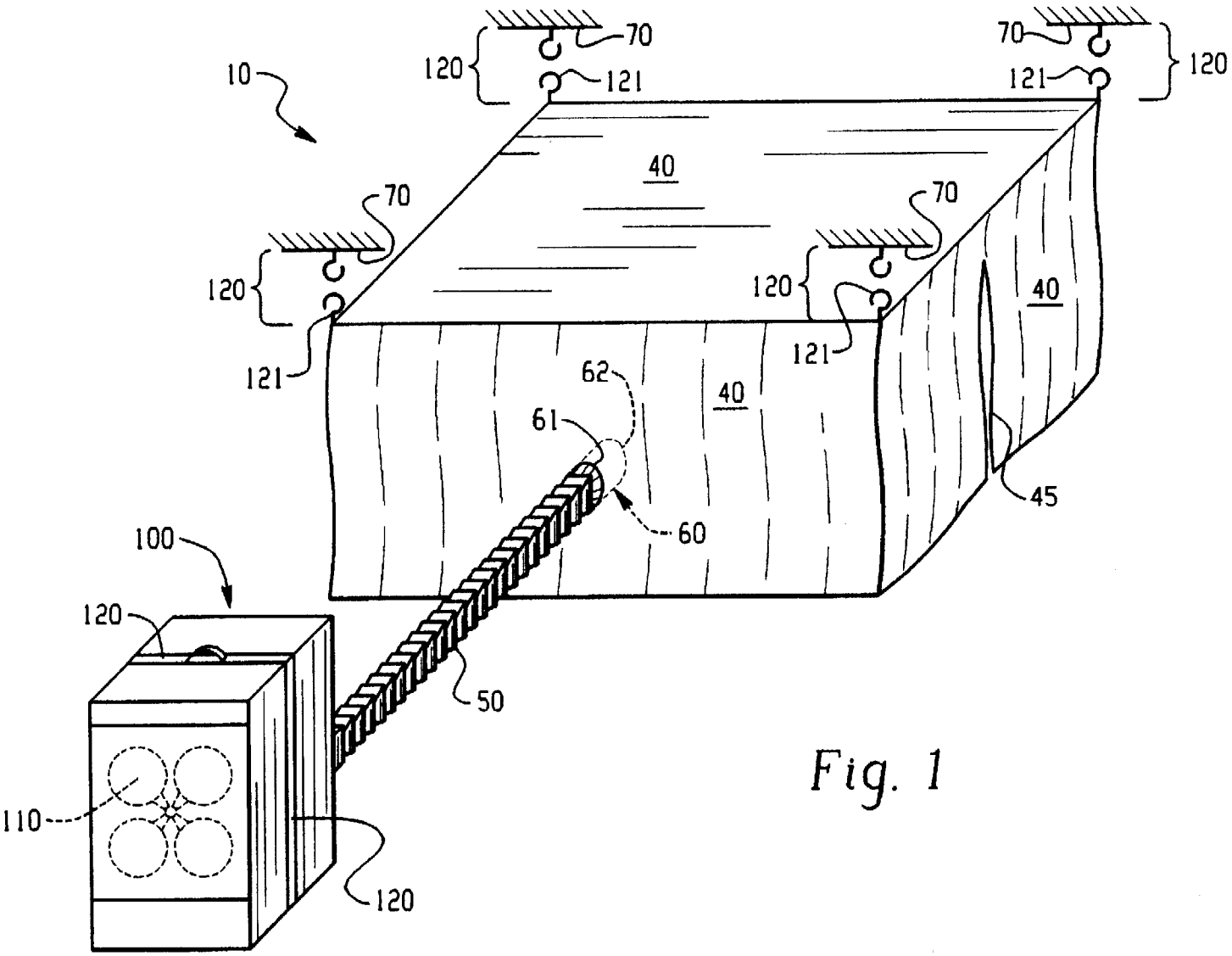
FIG. 1 is a perspective view of the portable and disposable environment.

Shown throughout the figures, the present invention is directed towards a portable and disposable operating environment, generally indicated as 10. The portable and disposable operating environment 10 is structured for rapid erection in a variety of locations in order to quickly provide a safe, sterile operating environment within which a variety of routine procedures may be performed.

The portable and disposable operating environment 10 includes at least one generally large, substantially flexible material panel 40. The flexible material panel 40 is preferably constructed of at least one lightweight, plastic material panel, and in an alternative embodiment can include both an interior material layer 20 and an exterior material layer 30, to be described in greater detail subsequently. As to the plastic material composition, it can be opaque or transparent, so long as the material itself is fluid impervious. Moreover, the material panel 40 will preferably be of a disposable construction so as to permit a used or contaminated material panel 40 to be discarded and easily replaced with a new, sterile material panel 40 when necessary.

The flexible material panel 40 is structured to define and drape over an operating area within which the sterile environment is maintained. In particular, the portable and disposable operating environment 10 of the present invention includes a generally rigid support 70 to which the flexible material panel 40 is secured by fasteners or fastening means 120. The fastening means 120 are structured and disposed so as to provide facilitated, removable securing of the flexible material panel 40 to the rigid support 70, and thereby provide for quick and effective coverage of the operating area by the flexible material panel 40.

Figure 5:
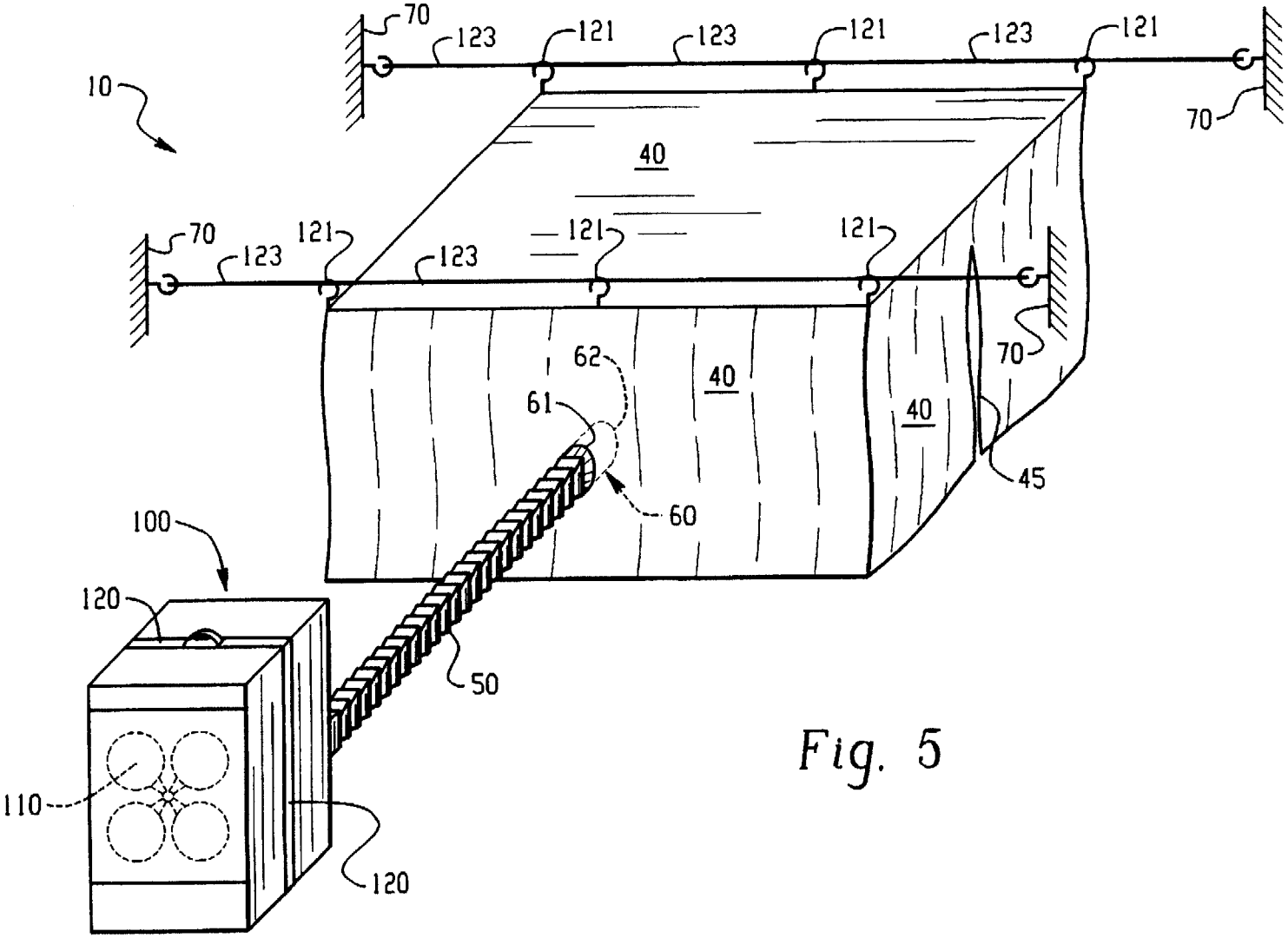
FIG. 5 is a perspective view of an alternative embodiment of the portable and disposable environment in which the rigid support includes a wall.

The rigid support 70, to which the flexible material panel 40 is secured, can include any structure of sufficient strength and elevation to maintain the flexible material panel 40 draped in a functional position. For example, in a preferred embodiment, the rigid support 70 may include a ceiling structure of a room in which the operating area is to be defined. Further, depending on the particular type of ceiling structure of the room, the fastening means 120 will secure the material panel 40 directly to the ceiling structure, to a framework thereof, or to a strong, rigidly disposed fixture thereon. Fortunately, the plastic material construction of the flexible material panel 40 makes it relatively lightweight, and therefore easier to support. Alternatively, as shown in FIG. 5, however, the rigid support 70 may include one or more wall surfaces of the room or structure in which the operating area is defined. As can be appreciated, the wall structure, ceiling structure, and/or fixtures thereon may be utilized in any combination to effectively provide the rigid support 70. In circumstances where such a permanent structure is not available, such as at a remote location, however, the rigid support 70 may include one or more portable collapsible support members 90. The collapsible support members 90 are structured to provide for easy storage and transportability, while also effectively providing for appropriate definition of the operating area. As such, the portable collapsible support member 90 may include a plurality of telescoping segments 91 which function to vary the length of the support member 90 to an effective orientation. Furthermore, the individual support members, which can include a variety of effective configurations, may include a number of connectors or extension arms 92 which can removably secure a number of the support members 90 with one another to define a support framework, or which can provide an extension for more balanced, stable supporting of the material panel 40 between a fewer number of support members 90.

Figure 4:
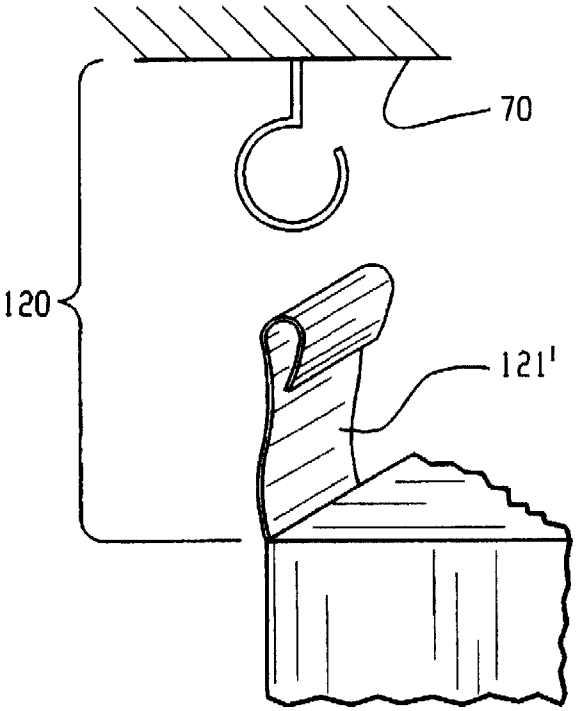
FIG. 4 is a partial perspective view showing an alternative embodiment in which the fastening means include flexible material segments.
Figure 3:
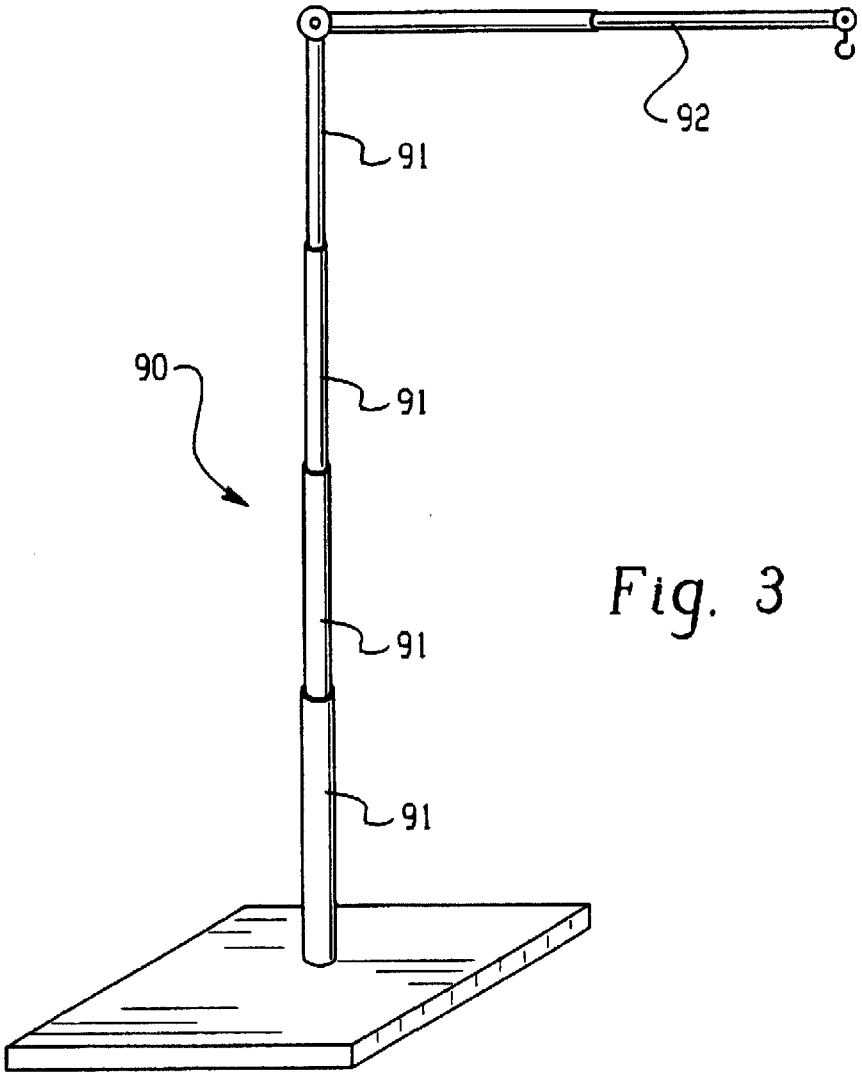
FIG. 3 is a perspective view showing a collapsible support member which, in an alternative embodiment, is to be used with the present invention.

As mentioned, the fastening means 120 are structured to removably secure the flexible material panel 40 to the rigid support 70. In the preferred embodiment, the fastening means will include a plurality of material loops or straps, or hooks 121 structured to secure the flexible material panel 40 to the rigid support 70. As such, the hooks 121 may be permanently secured to an upper portion of the flexible material panel 40, for removable securing to any effective retention location, such as a ceiling framework or a number of corresponding loops or hooks secured to the ceiling for securing purposes. Alternatively, the hooks 121 may be permanently or removeably secured to the rigid support 70 for subsequent securing passage through a plurality of apertures and eyelets formed in the flexible material panel 40. Also, in an alternative embodiment, which is particularly effective when the rigid support 70 includes a wall surface, a string or wire member 123 may be suspended in the room between the rigid supports so as to provide for the securing of the hooks 121 thereto to support the flexible material panel 40 as shown in FIG. 5. Further, in yet another alternative embodiment, the fastening means 120 may include one or more flexible material segments 121' secured to the flexible material panel 40 for appropriate fastening to the rigid support 70 as shown in FIG. 4.

Turning to the flexible material panel 40 of the portable and disposable operating environment 10, it includes at least one flow through passage 50 structured to direct air flow through the flexible material panel 40 and into the operating area defined thereby. In the preferred embodiment, wherein the flexible material panel 40 of the portable and disposable environment 10 includes the interior material layer 20 and the exterior material layer 30, the exterior material layer 30 is preferably constructed of a flexible, pliable, resilient sheet, which is substantially gas impervious, and includes a sterilized air flow inlet 60. The sterilized air flow inlet 60 defines a first end 61 of the flow through passage 50. Conversely, the interior material layer 20 of the flexible material panel 40, which is also constructed of a flexible, pliable, resilient sheet, includes at least one, but preferably a plurality of perforations 21 formed therein to define a second end 62 of the flow through passage 50. As such, purified/sterilized air directed into the flow through passage 50 is able to flow freely into the operating area. Furthermore, the perforated structure of the interior material layer 20 allows the sterilized air to be evenly distributed into the operating area, thereby more effectively providing the sterilized operating area. In particular, a true operating room, while maintained quite clean, is not completely sterile in every respect. In fact, it is generally only those items that will come into direct contact with the patient that are truly sterile. Further, because those items come into contact with the air/environment within the operating room, the circulating air within the operating room must also be maintained sterile. Accordingly, the portable and disposable operating environment 10 of the present invention is able to effectively approximate the traditional operating room by providing a sterile air environment within which sterile operating equipment may be implemented safely on the patient. Additionally, although a single perforation may be included to provide for a continuous sterilized air flow into the operating area, the preferred embodiment includes a number of perforations 21 to better facilitate the even distribution of the air into the operating area in order to more effectively evacuate unsterilized air until eventually only sterilized air circulates through the portable and disposable environment 10.

Figure 2:
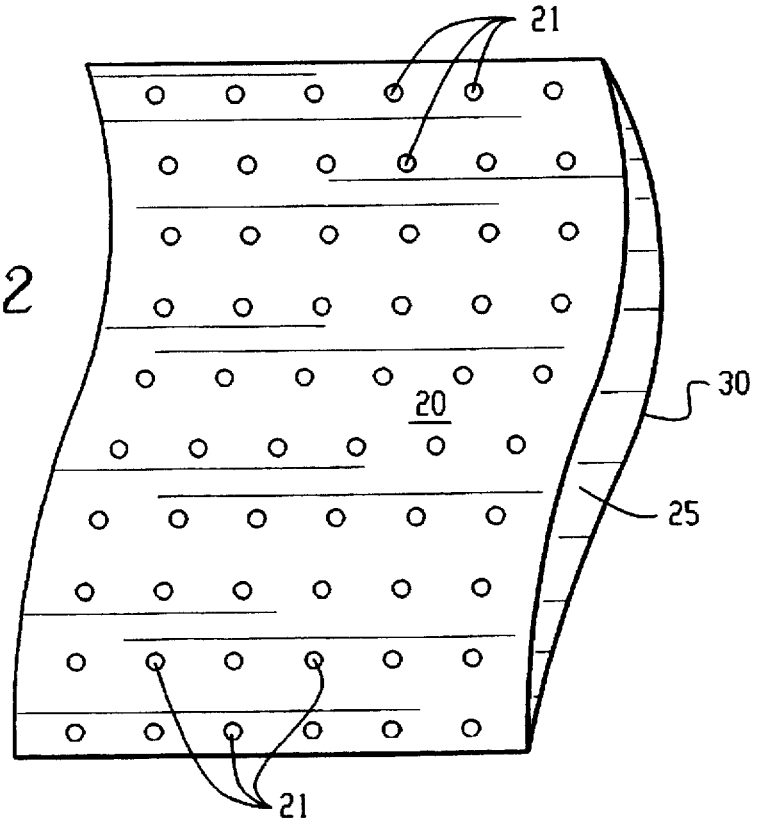
FIG. 2 is a partial view showing a section of the flexible material panel including the interior material layer, the exterior material layer and the air pocket therebetween.
Figure 2A:
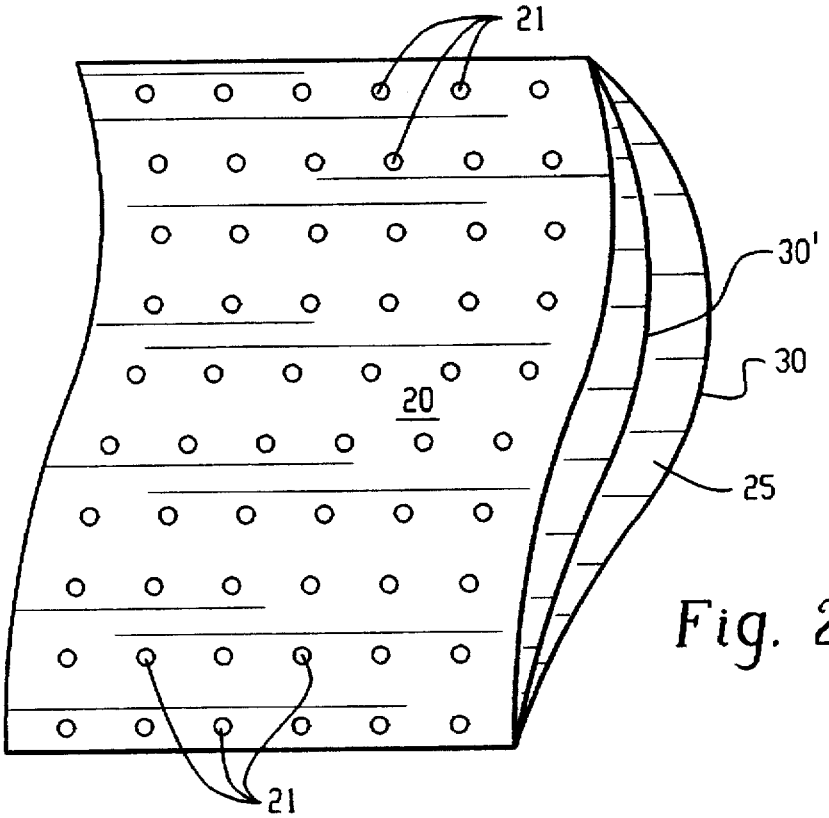
FIG. 2A is a partial view showing a section of an alternative embodiment of the flexible material panel including the interior material layer, an intermediate material layer, the exterior material layer and the air pocket therebetween.

In the preferred embodiment, the interior material layer 20 and the exterior material layer 30 are secured with one another so as to define at least one sterile air pocket 25 therebetween. The air pocket 25 is structured so that introduction of air into the sterile air pocket 25 will provide some rigidity and definition to the overall exterior material layer. Furthermore, when a new material layer 40 is secured to the rigid supports 70 in a collapsed, storage orientation, gradual filling of the air pocket 25 results in easy, automatic expansion of the flexible material panel 40 into an operating area defining and enclosing orientation. It is noted that the plurality of perforations 21 of the preferred embodiment are generally sufficiently small so as to permit the air pocket 25 to fill up and be maintained inflated despite the free air circulation out of the perforations 21. In an alternative embodiment, as in FIG. 2A, an intermediate material layer 30' is disposed between the interior and exterior material layers 20 and 30. The intermediate material layer 30' includes only a small number of openings formed therein so as to provide for rigidity of the material panel 40 between it and the exterior material layer 30 and gradual seepage towards the interior material layer 20 for free flow through the plurality of perforations. Regardless, prior to use the material panel 40 is structured to be conveniently stored such that a plurality of panels 40 may be maintained ready for use subsequent to disposal of a used material panel 40. Also, although it is preferred that the material panel 40 be used only once prior to disposal, it is noted that the material panel 40 may be stored, sterilized and re-used in some circumstances.

The flexible material panel 40 of the portable and disposable environment 10 preferably includes one or more individual panels to define the overall configuration thereof. Further, in the preferred embodiment the flexible material panel 40 defines a generally rectangular, hood like configuration having a plurality of walls and a ceiling structure. Still, however, any geometric configuration such as a dome or a pyramid may also be included, so long as it functions to cover and define the operating area.

Whichever configuration is implemented, the flexible material panel 40 is structured to extend at least partially, but preferably completely, to a floor surface beneath the operating area. Furthermore, because only those items that come into contact with the patient, as well as the air, need to be sterilized, the portable and disposable operating environment 10 of the present invention may be erected without removing existing furniture or fixtures from a room. Similarly, no special floor covering or even securing of the walls of the flexible material panel 40 to the floor must be achieved to provide effective air flow circulation. In fact, in the present invention, the plurality of perforations 21 on the interior material layer 20 permit the continuous even flow of sterilized air into the operating area, evacuating the un-sterilized air contained therein out beneath the bottom end of the flexible material panel 40 so that eventually only sterile air circulates. As such, in order to allow for the unsterilized air to be evacuated from the operating area, the flexible material panel 40 will therefore preferably extend substantially, but not completely to the floor surface of the operating area.

Structured to provide the sterilized air flow, and direct it through the flow through passage 50, so that there is continuous circulation of sterile air throughout the operating area, the portable and disposable environment 10 includes purified air supply means 100. Preferably, the purified air supply means 100 including a cool air blower 110 connected with a high density air filter 120 structured to substantially remove microbes and contaminants from air being blown therethrough. Once sterilized, the air is directed into the flow through passage 50 by way of sterile, and preferably disposable tubing, thereby providing for the free flow of filtered, sterilized air into the operating area. In an alternative embodiment, the cool air blower 110 may include an existing room air conditioning duct connected with an air conditioner. So long as the room air conditioning system is properly configured to consistently blow air through the corresponding duct, that air can be directed through a corresponding filter 120 for subsequent usage of the filtered, sterilized air into the flow through passage 50.

Lastly, an access opening 45 may be formed in a side of the flexible material panel 40 for entering and exiting the portable and disposable environment 10. The access opening 45 may be secured by buttons, a zipper, hook and loop strips, or other well known fastening devices which can function to maintain the operating area enclosed, while permitting convenient entry and egress.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A portable sterilized operating environment capable of being secured to an associated rigid support, comprising:

at least one large, substantially flexible material panel being structured to be substantially collapsible so as to facilitate storage and transportability thereof, fasteners structured and disposed to removably secure said flexible material panel to said associated rigid support such that said flexible material panel at least partially defines and drapes over an operating area, said flexible material panel further including a generally hood like configuration, having an at least partially open bottom end, and structured to be effectively and quickly draped over the operating area without requiring removal of items within the operating area, the panel including first and second layers defining a pocket therebetween, the first layer having plural perforations communicating with the operating area, at least one flow through passage structured to direct fluid flow into said operating area defined by said flexible material panel, a purified air supply structured to sterilize air flow therethrough and direct said sterilized air into said flow through passage, and said flow through passage being connected in fluid flow communication with the panel pocket for expanding the flexible material panel into an operating area defining and enclosing orientation and in fluid communication with the perforations disposed in the first layer of the flexible material panel and thereby establish a laminar flow of sterile air which continuously evacuates non-sterile air freely through said open bottom end of said flexible material panel and maintains a sterile operating environment.

2. A portable and disposable operating environment as recited in claim 1 wherein said flexible material panel is constructed of at least one plastic material panel.

3. A portable and disposable operating environment as recited in claim 1 wherein said rigid support includes a wall surface of a room in which said operating area is defined.

4. A portable and disposable operating environment as recited in claim 1 wherein said rigid support includes a ceiling structure of a room in which said operating area is defined.

5. A portable and disposable operating environment as recited in claim 1 wherein said fastening means includes at least one hook structured to securely engage said flexible material panel.

6. A portable and disposable operating environment as recited in claim 1 wherein said fastening means includes at least one elongate flexible material segment secured to said flexible material panel and said rigid support.

7. A portable and disposable operating environment as recited in claim 1 wherein said rigid support includes at least one portable, collapsible support member structured to suspend said flexible material panel at a generally elevated position.

8. A portable and disposable operating environment as recited in claim 1 wherein said first and second layers comprises:

an interior material layer, an exterior material layer, said exterior material layer being substantially gas impervious and having at least one sterilized air flow inlet which defines a first end of said flow through passage, and said interior material panel including said plural perforations are structured to define a second end of said flow through passage and thereby permit the free flow of sterilized air into said operating area.

9. A portable and disposable operating environment as recited in claim 8 wherein said interior material layer and said exterior material layer define a sterile air pocket therebetween.

10. A portable and disposable operating environment as recited in claim 9 wherein said exterior material layer is structured to be secured to said generally rigid support when said flexible material panel is in a collapsed orientation such that the introduction of air into said sterile air pocket results in the automatic expansion of said flexible material sheet into an expanded, operating area defining orientation.

11. A portable and disposable operating environment as recited in claim 1 wherein said flexible material panel is structured to extend substantially to a floor surface of said operating area.

12. A portable and disposable operating environment as recited in claim 1 wherein said purified air supply means includes:

a cool air blower, an air filter connected with said cool air blower and structured and disposed to substantially remove microbes from air passing through said cool air blower, and sterile tubing disposed in flow-through, connecting relation between said cool air blower and said flow through passage so as to provide for the free flow of filtered, sterilized air into said operating area.

13. A portable and disposable operating environment as recited in claim 1 wherein said purified air supply includes an existing room air conditioning duct connected with an air filter and said flow through passage via sterilized tubing.

14. A portable and disposable operating environment as recited in claim 1 wherein said flexible material panel is disposable.

15. A portable sterilized operating environment as recited in claim 1 wherein said plurality of perforations are disposed long an entire upper region of said flexible material panel so as to effectively and completely direct non-sterile air to said open bottom of said flexible material panel.

* * * * *